US005747437A

United States Patent [19]

Michaud

[11] Patent Number: 5,747,437

[45] Date of Patent: May 5, 1998

[54] CLEANING COMPOSITIONS BASED ON 1,1,1,2,2,4,4-HEPTAFLUOROBUTANE AND $C_1$-$C_3$ ALCOHOLS

[75] Inventor: Pascal Michaud, Saint-Gratien, France

[73] Assignee: Elf Atochem S.A., France

[21] Appl. No.: 739,602

[22] Filed: Oct. 30, 1996

[30] Foreign Application Priority Data

Oct. 31, 1995 [FR] France ..... 95 12843

[51] Int. Cl.[6] ..... C11D 7/50; C23G 5/028

[52] U.S. Cl. ..... 510/177; 510/175; 510/178; 510/255; 510/410; 510/409; 510/411; 510/365; 252/67; 134/40; 134/38; 134/42

[58] Field of Search ..... 510/177, 176, 510/175, 178, 255, 408, 410, 409, 411, 412, 415, 407, 365; 252/67; 134/2, 40, 38, 42

[56] References Cited

U.S. PATENT DOCUMENTS

| | | | |
|---|---|---|---|
| 5,073,291 | 12/1991 | Robeck et al. | 252/171 |
| 5,118,359 | 6/1992 | Li et al. | 134/42 |
| 5,219,490 | 6/1993 | Basu et al. | 252/171 |
| 5,250,208 | 10/1993 | Merchant et al. | 252/67 |
| 5,266,232 | 11/1993 | Robeck et al. | 252/171 |
| 5,268,121 | 12/1993 | Michaud | 252/171 |
| 5,346,645 | 9/1994 | Omure et al. | 252/194 |
| 5,350,534 | 9/1994 | Michaud | 252/171 |
| 5,424,002 | 6/1995 | Omure et al. | 252/171 |
| 5,445,757 | 8/1995 | Pennetreau | 252/171 |
| 5,494,601 | 2/1996 | Flynn et al. | 252/171 |
| 5,531,916 | 7/1996 | Merchant | 510/412 |
| 5,538,665 | 7/1996 | Paulus et al. | 252/67 |
| 5,569,796 | 10/1996 | Yamada et al. | 570/175 |
| 5,667,594 | 9/1997 | Omure et al. | 134/26 |

FOREIGN PATENT DOCUMENTS

| | | |
|---|---|---|
| A-05-214372 | 8/1993 | Japan . |
| A-05-269302 | 10/1993 | Japan . |
| A-05-302098 | 11/1993 | Japan . |
| A-06-049491 | 2/1994 | Japan . |
| A-06-100891 | 4/1994 | Japan . |

*Primary Examiner*—Douglas J. McGinty
*Attorney, Agent, or Firm*—Bell, Boyd & Lloyd

[57] ABSTRACT

To replace compositions based on CFC or CFHC in applications for cleaning solid surfaces (in particular defluxing), the invention proposes azeotropic or quasi-azeotropic compositions based on 1,1,1,2,2,4,4-heptafluorobutane and a $C_1$–$C_3$ alcohol.

15 Claims, No Drawings

CLEANING COMPOSITIONS BASED ON 1,1,1,2,2,4,4-HEPTAFLUOROBUTANE AND $C_1$-$C_3$ ALCOHOLS

FIELD OF THE INVENTION

The present invention concerns the field of fluorohydrocarbons and relates more particularly to novel compositions which may be used to clean and degrease solid surfaces.

BACKGROUND OF THE INVENTION 1,1,2-Trichloro-1,2,2-trifluoroethane (known in the art under the name F113) has been widely used in industry for cleaning and degreasing very diverse solid surfaces (metal components, glass, plastics, composites). Besides its application in electronics to the cleaning of soldering fluxes in order to remove the soldering flux which adheres to printed circuits, mention may be made of its applications to the degreasing of heavy metal components and to the cleaning of high-quality and high-precision mechanical components such as, for example, gyroscopes and military, aerospace or medical equipment. In its various applications, F113 is usually combined with other organic solvents (for example, methanol), preferably in the form of azeotropic or quasi-azeotropic mixtures which do not demix and which, when employed at reflux, have substantially the same composition in the vapor phase as in the liquid phase.

However, the use of compositions based on F113 is now prohibited since F113 is among the chlorofluorocarbons (CFC) suspected of attacking or degrading stratospheric ozone.

In these various applications, F113 may be replaced by 1,1-dichloro-1-fluoroethane (known under the name F141b), but the use of this substitute is already regulated since, although weak, its destructive effect on ozone is not non-existent.

DESCRIPTION OF THE INVENTION

To contribute towards solving this problem, the present invention proposes to replace compositions based on F113 or on F141b by azeotropic or quasi-azeotropic compositions based on 1,1,1,2,2,4,4-heptafluorobutane. This compound ($CF_3CF_2CH_2CHF_2$ referred to hereinbelow as F347 mcf) is entirely devoid of any destructive effect on ozone and has properties similar to those of F113 and F141b.

| Properties | F113 | F141b | F347 mcf |
|---|---|---|---|
| Boiling point (°C.) | 47.6 | 32 | 33 |
| Surface tension at 25° C. ($mN \cdot m^{-1}$) | 19 | 19.1 | 14.2 |
| Density at 20° C. | 1.57 | 1.24 | 1.42 |
| Flash point (ASTM standard D 3828) | none | none | none |
| ODP (ozone-depletion potential) | 1.07 | 0.11 | 0 |

The compositions to be used according to the invention comprise, on a weight basis, from 90 to 99.9% of F347 mcf and from 0.1 to 10% of a lower alcohol (methanol, ethanol, n-propanol or isopropanol).

A particularly preferred composition according to the invention is that which comprises, on a weight basis, 90 to 99% of F347 mcf and 1 to 10% of methanol. In this field, an azeotrope exists whose boiling point is 30.6° C. at normal atmospheric pressure (1.013 bar). This composition has no flash point under the standard determination conditions (ASTM standard D 3828) and thus makes it possible to work in total safety.

As with the known cleaning compositions based on F113 or on F141b, cleaning compositions based on F347 mcf according to the invention may, if so desired, be stabilized against hydrolysis and/or radical attacks which may occur in cleaning processes, by adding a common stabilizer thereto such as, for example, a nitroalkane (nitromethane, nitroethane, nitropropane, etc.), an acetal (dimethoxymethane) and 1,4-dioxolane, it being possible for the proportion of stabilizer to range from 0.01 to 5% relative to the total weight of the composition.

The compositions according to the invention may be used in the same applications and according to the same techniques as the prior compositions based on F113 or on F141b.

The examples which follow illustrate the invention without limiting it.

EXAMPLES

EXAMPLE 1: F347 mcf/Methanol Azeotrope a) Demonstration of the azeotrope 100 g of F347 mcf and 100 g of methanol are introduced into the distillation vessel of a distillation column (30 plates). The mixture is then placed under full reflux for one hour in order to bring the system to equilibrium.

When the temperature is steady (30.6° C.), a fraction of about 50 g is collected and analyzed by gas chromatography.

Examination of the results, presented in the following table, indicates the presence of an F347 mcf/methanol azeotrope.

| | Composition (% by weight) | |
|---|---|---|
| | F347 mcf | $CH_3OH$ |
| Initial mixture | 50 | 50 |
| Fraction collected at 30.6° C. | 97.4 | 2.6 |

b) Verification of the azeotropic composition 200 g of a mixture comprising 97.4% by weight of F347 mcf and 2.6% by weight of methanol are introduced into the distillation vessel of an adiabatic distillation column (30 plates). The mixture is then maintained at reflux for one hour in order to bring the system to equilibrium, then a fraction of about 50 g is removed and analyzed by gas chromatography, as is a fraction of the distillation residue. The results presented in the following table show the presence of an azeotrope.

| | Composition (% by weight) | |
|---|---|---|
| | F347 mcf | $CH_3OH$ |
| Initial mixture | 97.4 | 2.6 |
| Fraction collected | 97.4 | 2.6 |
| Distillation residue | 97.4 | 2.6 |
| Boiling point corrected for 1.013 bar: 30.6° C. | | |

When used to clean soldering flux or to degrease mechanical components, this azeotrope gives good results.

EXAMPLE 2: Composition Stabilized With Nitromethane 150 g of a mixture containing, on a weight basis, 96.9% of F347 mcf, 3% of methanol and 0.1% of nitromethane as stabilizer are introduced into an ultrasound cleaning tank. After placing the system at reflux for one hour, an aliquot of the vapor phase is removed. Its analysis by gas chromatography shows the presence of nitromethane, which indicates that the mixture is stabilized in the vapor phase.

| | Composition (% by weight) | | |
|---|---|---|---|
| | F347 mcf | Methanol | $CH_3NO_2$ |
| Initial mixture | 96.9 | 3 | 0.1 |
| Vapour phase | 97.17 | 2.8 | 0.03 |

EXAMPLE 3: Cleaning of Soldering Flux

Five test circuits (IPC-25 standardized model) are coated with rosin-based flux (flux R8F from the company Alphametal) and are cured in an oven at 220° C. for 30 seconds.

These circuits are cleaned using a composition comprising 95% of F347 mcf and 5% of ethanol in an ultrasound machine for 3 minutes by immersion and for 3 minutes in the vapor phase.

The cleaning is evaluated according to the standardized procedure IPC 2.3.26 using a precision conductivity meter. The value obtained, 0.63 $\mu g/cm^2$ eq.NaCl, is very much lower than the ionic impurity threshold tolerated by the profession (2.5 $\mu g/cm^2$ eq.NaCl).

EXAMPLE 4

Working as in Example 1 with ethanol, it is demonstrated that an F347 mcf/ethanol azeotrope exists which boils at 32.4° C. at 1.013 bar and contains, on a weight basis, 98.45% of F347 mcf and 1.55% of ethanol.

EXAMPLE 5

By repeating Example 1 with isopropanol, it is demonstrated that an F347 mcf/isopropanol azeotrope exists containing, on a weight basis, 99.85% of F347 mcf and 0.15% of isopropanol. Its boiling point at 1.013 bar is 32.8° C.

The F347 mcf used in the above examples was prepared from 1,1,3,3,4,4,4-heptafluorobutyl iodide (R. D. Chambers et al., Tetrahedron 1964, vol. 20, pp.497–506) by a two-step process, the first consisting of a dehydroiodination of the iodide to form the olefin $CF_3CF_2CH{=}CF_2$ and the second consisting of the catalytic hydrogenation of the said olefin.

STEP 1: Synthesis of the olefin $CF_3{-}CF_2{-}CH{=}CF_2$

A one-liter glass reactor is used, fitted with a mechanical stirrer and a dropping funnel (500 ml) and on which a water-cooled condenser is mounted. The reactor is maintained with a gentle flush of nitrogen (10 to 20 ml/min) and the outlet of the condenser is connected to a metal trap maintained at −80° C., which makes it possible to recover the olefin formed which emerges from the reaction mixture in gaseous form (b.p. 10°–11° C./1 atm). Between the metal trap and the condenser are inserted a wash bottle containing water and then a drying tube containing calcium chloride.

502 g of the compound $CF_3{-}CF_2{-}CH_2{-}CF_2I$ (i.e. 1.62 mol) and 200 ml of water are loaded into the reactor. The mixture is brought to 50° C. with vigorous stirring and 180 g of triethylamine (i.e. 1.78 mol) are then run in over 30 to 60 minutes. The mixture is left for a further 30 minutes at 50° C. after all of the triethylamine has been run in.

272 g of olefin $CF_3{-}CF_2{-}CH{=}CF_2$ (1.49 mol) are then obtained in the metal trap. The purity of the product obtained is 99% (GC analysis).

STEP 2: Synthesis of F347 mcf

A tubular reactor made of Inconel (inside diameter: 28 mm, length: 420 mm) is used, heated with an electric strip and loaded with 48 g (100 ml) of a commercial Pd/charcoal catalyst containing 5% palladium.

The olefin synthesized in step 1 is hydrogenated in the gas phase on this preactivated catalyst by passing hydrogen through (100 ml/min) at 80° C. for one hour. The hydrogen (100 ml/min measured at 20° C.) and the olefin in gaseous form (40 ml/min measured at 20° C.) are then introduced. The reactor temperature is maintained at 80° C. At the reactor outlet, the F347 mcf is condensed in a trap maintained at −80° C.

For 622 g of olefin employed, 609 g of F347 mcf were obtained (yield: 97%) in greater than 95% purity (GC analysis) and whose structure was confirmed by NMR analysis in $CDCl_3$ solvent. The following table indicates, for the multiplets observed, the chemical shifts in ppm relative to TMS for the $^1H$ NMR analysis and relative to TFA (external reference) for the $^{19}F$ NMR analysis. The spectra were obtained on a Bruker AC 300 machine equipped with a QNP probe.

| | $CF_3$— | —$CF_2$— | —$CH_2$— | —$CF_2H$ |
|---|---|---|---|---|
| $^{19}F$ NMR | 8.82 | 39.33 | — | 36.88 |
| $^{13}C$ NMR | 118.5 | 113.2 | 36.3 | 116.6 |
| $^1H$ NMR | — | — | 2.66 | 6.14 |

Although the invention has been described in conjunction with specific embodiments, it is evident that many alternatives and variations will be apparent to those skilled in the art in light of the foregoing description. Accordingly, the invention is intended to embrace all of the alternatives and variations that fall within the spirit and scope of the appended claims.

I claim:

1. An azeotropic or azeotrope-like composition consisting essentially of, by weight of said composition, about 90–99% of 1,1,1,2,2,4,4-heptafluorobutane, about 1–10% of methanol, and optionally a stabilizer, wherein said composition has a boiling point of about 30.6° C. at normal pressure.

2. An azeotropic or azeotrope-like composition consisting essentially of, by weight of said composition, about 90–99% of 1,1,1,2,2,4,4-heptafluorobutane, about 1–10% of ethanol, and optionally a stabilizer, wherein said composition has a boiling point of about 32.4° C. at normal pressure.

3. An azeotropic or azeotrope-like composition consisting essentially of, by weight of said composition, about 90–99.9% of 1,1,1,2,2,4,4-heptafluorobutane, about 0.1–10% of isopropanol, and optionally a stabilizer, wherein said composition has a boiling point of about 32.8° C. at normal pressure.

4. The composition according to claim 1 further consisting essentially of at least one stabilizer.

5. The composition according to claim 2 further consisting essentially of at least one stabilizer.

6. The composition according to claim 3 further consisting essentially of at least one stabilizer.

7. A method of cleaning a solid surface comprising the step of contacting said surface with the composition of claim 1.

8. A method of cleaning a solid surface comprising the step of contacting said surface with the composition of claim 2.

9. A method of cleaning a solid surface comprising the step of contacting said surface with the composition of claim 3.

10. A method of defluxing a printed circuit comprising the step of contacting said circuit with the composition of claim 1.

11. A method of defluxing a printed circuit comprising the step of contacting said circuit with the composition of claim 2.

12. A method of defluxing a printed circuit comprising the step of contacting said circuit with the composition of claim 3.

13. A method of degreasing a mechanical component comprising the step of contacting said component with the composition of claim 1.

14. A method of degreasing a mechanical component comprising the step of contacting said component with the composition of claim 2.

15. A method of degreasing a mechanical component comprising the step of contacting said component with the composition of claim 3.

* * * * *